United States Patent [19]

Dersher

[11] 3,999,763

[45] Dec. 28, 1976

[54] SLIDE CALCULATOR

[76] Inventor: Charles L. Dersher, 2114 Audubon Pl., Toledo, Ohio 43606

[22] Filed: Feb. 3, 1976

[21] Appl. No.: 654,944

[52] U.S. Cl. ..... 273/148 R; 235/89 R

[51] Int. Cl.[2] ..... A63B 71/00

[58] Field of Search ..... 235/89, 1 R; 273/148 R, 273/135 R, 135 BC, 135 A, 135 B, 135 AB, 135 AA, 135 AC

[56] References Cited

UNITED STATES PATENTS 3,013,349 12/1961 Cooper ..... 273/148 R

FOREIGN PATENTS OR APPLICATIONS 350,864 6/1931 United Kingdom ..... 235/89 R

*Primary Examiner*—Ulysses Weldon

[57] ABSTRACT

A calculator to aid in selecting bingo cards to increase the odds of winning. A fixed frame member has a slide member freely movable relative to it. The front face of the frame has a transverse slot and an indicator. Adjacent the slot, along its length, is an indicia scale made up of the letters BINGO. The slide member has a plurality of transverse scales, each corresponding to a particular form of bingo game. The scales each have a corresponding indicia, identifying the particular game, which is spaced a distance substantially equal to the distance from the slot to the indicator plus the width of a scale. When an indicia is aligned with the indicator, its corresponding scale is visible in the slot and aligns with the letters BINGO. The numbers of the scale tell which numerals should be chosen under each letter to increase the chances of winning.

1 Claim, 3 Drawing Figures

SLIDE CALCULATOR

BACKGROUND OF THE INVENTION

This invention generally relates to slide type calculators. More specifically, this invention relates to a slide type calculator of the type wherein a movable slide member has printed thereon a plurality of transverse scales which can be seen one-at-a-time through a slot in a fixed member. Specifically, this invention relates to such a calculator which contains scales with desired numbers to be chosen under each letter of a bingo card for a variety of types of bingo games.

Most persons are familiar with the game of bingo. A series of number and letter combinations are drawn at random and a person tries to match these numbers on squares defining a 5×5 matrix under the letters B, I, N, G, O. This game is played only with numbers 1–75, which thus limits the number of possible combinations. In addition, the bingo playing cards are not printed in a truly random sequence using all possible numerical and letter combinations. Rather, the cards are presently printed in what are called "sets" of 6,000 different cards. With these mathematical factors in mind, and the right of a player to choose his own card from a set, it is possible to calculate those numerical combinations on playing cards under the five letters which should maximize the changes of winning. These combinations vary somewhat depending upon the precise variety of bingo being played. There are, in fact, at least 10 commonly played game varieties. Using the precalculated factors to choose a playing board for all of these varieties can become confusing and time consuming. As an aid to this determination, I have devised a slide type calculator for use in selecting a game board. The desirable number combinations for several different games are placed on a movable slide. The slide may be moved in a fixed frame to make one set of combinations visible at a time corresponding to the game variety being played. Use of a properly designed index factor allows quick and accurate selection of the correct number combinations.

SUMMARY OF THE INVENTION

My invention resides in a calculator for selecting bingo cards according to a logical numerical sequence for a plurality of varieties of bingo games. The calculator includes a tubular frame member which includes a front face having a transverse window formed therein. Lying along substantially the entire length of the window is an indicia scale, the scale being divided into five substantially equal segments corresponding to the letters B, I, N, G, O. An indicator is formed on the front surface of the frame at one edge of the frame. The calculator also includes a slide member inserted in and freely movable with respect to the frame member. The slide member has formed thereon a plurality of transversely extending scales positioned in abutting relationship in a longitudinal array. Each of the scales has a width substantially equal to the width of the window and are divided into five segments corresponding to the indicia scale on the front face of the frame member. Each of the scales corresponds to a different bingo game and shows different number patterns under each letter of a bingo card. The slide member also has formed thereon a plurality of longitudinally extending indicia, each of the scales having a corresponding indicia. The spacing between individual ones of the scales and its corresponding indicia is substantially equal to the distance between the window and the indicator plus the width of one of the scales. This arrangement requires that when the indicator is aligned with one of the indicia on the slide member, the indicia will be outside of the frame member and its corresponding scale will be visible in the window. This allows correspondence of the information on the scale and the indicia scale of the letters B, I, N, G, O on the front face.

DETAILED DESCRIPTION OF THE DRAWINGS

Figure 1:
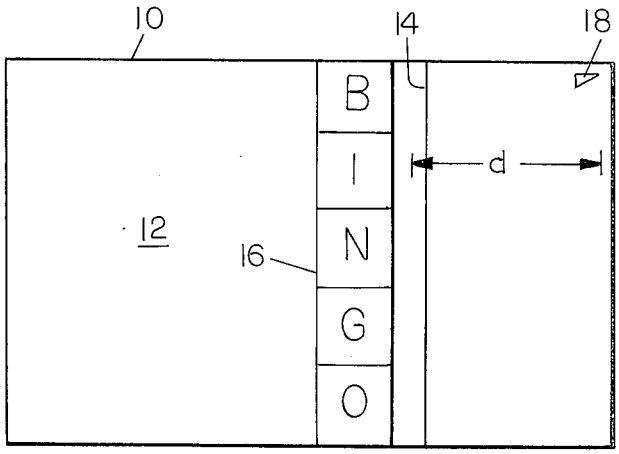
FIG. 1 is a plan view of the frame member of the present invention.

FIG. 1 illustrates an outer wrapper or frame member 10. The frame 10 is of a generally tubular configuration. The frame 10 includes a front face 12 which has a transverse slot or window 14 formed therein. In the case illustrated, there is an actual slot cut in the frame 10. However, a transparent window in a plastic frame 10 would serve the same purpose. The words slot and window are thus equivalent in this sense. Lying along the length of the slot 14 is an indicia scale 16, in this case made up of the letters BINGO. An indicator or pointer 18 is printed on the front face 12. The pointer 18 is positioned in the upper right hand corner of the front face 12.

Figure 2:
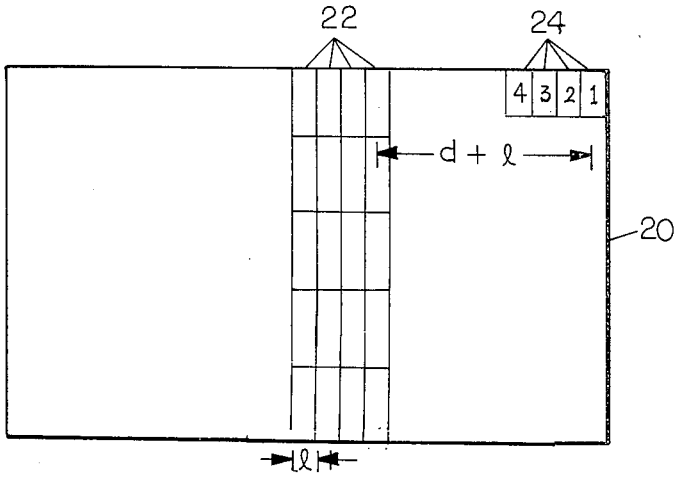
FIG. 2 is a plan view of the slide member of the present invention.

FIG. 2 illustrates a slide member 20 which makes up the second portion of the complete calculator of the present invention. The slide member 20 is of a size to fit inside the frame 10 and move freely within it. Printed or otherwise impressed on the slide 20 are a plurality of transversely extending scales 22. The scales 22 are positioned in an abutting configuration extending along the length of the slide 20. A plurality of indicia 24 are printed or otherwise impressed on the slide 20 in the upper right hand corner thereof. The number of the indicia 24 corresponds in number to the number of transverse scales 22. The spacing from each scale 22 to a corresponding indicia 24 is fixed to allow alignment of an indicia 24 with the pointer 18 while its corresponding scale 22 is visible in the slot 14. The distance from the slot 14 to the pointer 18 is fixed at *d.* The distance from each scale 22 to its corresponding indicia 24 is fixed at *d* plus 1, with 1 being the longitudinal dimension of each scale 22. This spacing arrangement then means that when an indicia 24 is outside the frame 10 and aligned with the pointer 18, its corresponding scale 22 is visible in the slot 14.

Each of the scales 22 are different and correspond to different types of bingo games. The odds of winning at bingo are not truly random since bingo cards are not randomly printed. Rather, there are only a specific and relatively limited number of sets of cards printed. Taking this knowledge into account, the numbers which should occur under each letter for various bingo game variations to maximize the odds of winning can be predicted. Such game varieties include cloverleaf, B & 0, small diamond, and many others. Thus, each scale 22 corresponds to one of these games, the scales being divided into five equal divisions along its length to match the letters BINGO of the indicia scale 16.

Figure 3:
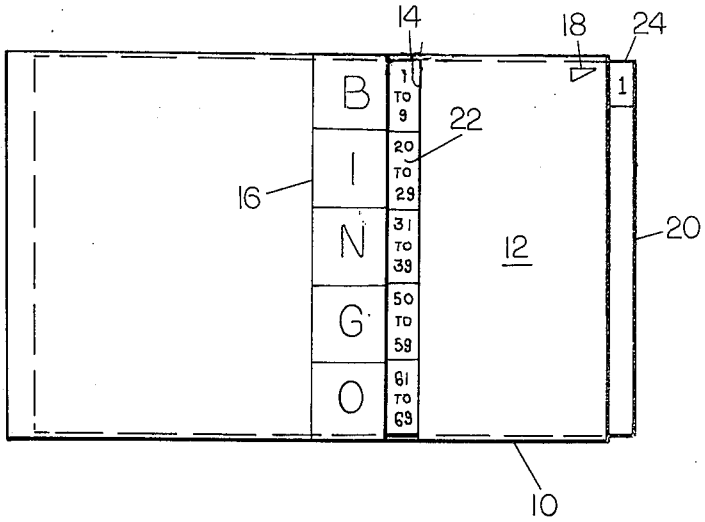
FIG. 3 is a partial plan view, on an enlarged scale, of an assembled calculator of the present invention illustrating its operation.

FIG. 3 illustrates the operation of the calculator of the present invention. The slide member 20 is inserted into the frame member 10. One of the indicia 24, corresponding to a particular type of game to be played, is positioned adjacent the indicator 18 by moving the slide member 20 relative to the frame member 10. As has been noted, the relative distance between indicia 24 and corresponding scale 22 is fixed to show a scale 22 in the slot 14 when its indicia 24 is aligned with the pointer 18. The scale 22 of FIG. 3 is one used for a standard bingo game. The five divisions of the scale 22 are clearly illustrated to show the numerals which should appear under each letter on the card. For example, the numerals under the letter B should be from 1 to 9, under O from 61 to 69.

What I claim is:

1. A calculator for selecting bingo cards according to a logical numerical sequence for a plurality of varieties of bingo games which comprises, in combination:

a tubular frame member, said frame member including a front face having a transverse window formed therein with an indicia scale lying along the length of said window, said indicia scale being divided into five segments corresponding to the letters BINGO;

an indicator formed on the front surface of said frame at one edge thereof;

a slide member, inserted in and freely movable with respect to said frame member, said slide member having formed thereon a plurality of transversely extending scales positioned in abutting relationship in a longitudinal array, each of said scales having a width substantially equal to the width of said window and being divided into five sections corresponding to the indicia scale positioned on the front face of said frame member, each one of said scales corresponding to a different game and showing different number patterns under each letter of a bingo card; and a plurality of longitudinally extending indicia formed on said slide member, each of said scales having a corresponding indicia, the spacing between individual ones of said scales and its corresponding indicia being substantially equal to the distance between said window and said indicator plus the width of one of said scales whereby alignment of an indicia with said indicator will place a scale in said window to present correspondence of said scale and said indicia scale on said front face.

* * * * *